US006108832A

United States Patent [19]

McIntire

[11] Patent Number: 6,108,832

[45] Date of Patent: Aug. 29, 2000

[54] SINK ASSEMBLY WITH SINK TOP AND INTERCHANGEABLE BASES

[76] Inventor: Bryan C. McIntire, 6325 Elvas Ave., Sacramento, Calif. 95819

[21] Appl. No.: 09/061,490

[22] Filed: Apr. 17, 1998

Related U.S. Application Data

[60] Provisional application No. 60/044,615, Apr. 18, 1997.

[51] Int. Cl.[7] ..... E03C 1/326

[52] U.S. Cl. ..... 4/646; 4/643

[58] Field of Search ..... 4/646, 643, 645, 4/648; D23/292, 308; 312/228, 351.2, 351.3

[56] References Cited

U.S. PATENT DOCUMENTS

| | | | |
|---|---|---|---|
| D. 292,732 | 11/1987 | Gates et al. | D23/292 |
| D. 311,769 | 10/1990 | Nosari | D23/292 |
| D. 318,909 | 8/1991 | Lencios | D23/292 |
| D. 320,437 | 10/1991 | McKeone | D23/292 |
| D. 321,754 | 11/1991 | Reid | D23/292 |
| D. 347,272 | 5/1994 | Reid | D23/292 |
| D. 368,768 | 4/1996 | Kaiser | D23/292 |
| D. 368,769 | 4/1996 | Kaiser | D23/292 |
| D. 370,718 | 6/1996 | Blatchley | D23/292 |
| D. 376,195 | 12/1996 | McKeone | D23/308 |
| D. 384,403 | 9/1997 | Wagner | D23/292 |
| D. 387,419 | 12/1997 | Laguera Garza | D23/292 |
| 938,157 | 10/1909 | Lose | 4/646 |
| 2,247,235 | 6/1941 | Hause | 4/646 |
| 3,565,501 | 2/1971 | Bowen et al. | 312/228 |

*Primary Examiner*—Henry J. Recla
*Assistant Examiner*—Tuan Nguyen
*Attorney, Agent, or Firm*—Flanagan & Flanagan; John K. Flanagan; John R. Flanagan

[57] ABSTRACT

A sink assembly includes a sink top, a sink base being one or the other of at least two different styles, such as a central pedestal or a pair of front corner legs, and an arrangement of mounting elements defined on the different sink bases and at different locations on an underside of the sink top providing interchangeability of one for the other of the different styles of bases with the one sink top. The sink top has a basin, underside and pair of front corners. A first of the mounting elements in the arrangement thereof includes a convex-shaped bottom portion on the underside of the sink top at the basin thereof for receiving and supporting a first of the different sink bases in the form of a central pedestal at the location of the bottom portion of the basin. A second of the mounting elements in the arrangement thereof includes slots defined in the underside of the sink top at the front corners thereof and fasteners engageable with the slots for receiving and supporting a second of the different sink bases in the form of a pair of support legs at the locations of the slots. The first and second of the mounting elements adapt the sink top to permit interchangeability of one for the other of the first and second sink bases with the sink top in providing the sink assembly.

10 Claims, 2 Drawing Sheets

SINK ASSEMBLY WITH SINK TOP AND INTERCHANGEABLE BASES

This application claims the benefit of provisional application Ser. No. 60/044,615, filed Apr. 18, 1997.

BACKGROUND OF THE INVENTION

1. Field of the Invention

The present invention generally relates to sink assemblies and, more particularly, is concerned with a sink assembly with a sink top and interchangeable bases.

2. Description of the Prior Art

Heretofore, manufacturers and marketers of sinks, such as antique porcelain sinks, have been producing and selling sinks in a variety of designs having different styles of bases fixedly attached with tops of one or more designs. These manufacturers and marketers must keep a sizable inventory containing multiple sinks having all of the various possible combinations of base styles and top designs in order to be ready to satisfy the needs of all possible consumers who at any time may choose any one of these combinations.

This practice requires the maintenance of a large inventory of units which vary only slightly in design from one another. This practice has been costly in terms of the financial investment in materials and in space in the storage of the units.

Consequently, a need still exists for an assembly which provides a solution to the aforementioned problem in the prior art without introducing any new problems in place thereof.

SUMMARY OF THE INVENTION

The present invention provides a sink assembly and sink top which are designed to satisfy the aforementioned need. The sink assembly of the present invention provides multiple sink bases which are interchangeable with a sink top of a given design. The sink base interchangeability of the present invention enables the manufacturers and marketers of sink assemblies to have substantially fewer units in stock and yet at the same time provide consumers with a wide range of choices in designs. The sink assembly of the present invention is cost effective in comparison with prior art assemblies.

Accordingly, the present invention is directed to a sink assembly which comprises: (a) a sink top; (b) a sink base being one or the other of at least first and second sink bases of first and second styles being different from one another; (c) first mounting means defined on the first sink base and at a first location on the sink top for receiving and supporting the sink top on the first sink base; and (d) second mounting means defined on the second sink base and at a second location on the sink top for receiving and supporting the sink top on the second sink base. The second mounting means is different from the first mounting means and the second location of the second mounting means on the sink top is different from the first location of the first mounting means on the sink top such that the first and second mounting means provide interchangeability of one for the other of the first and second sink bases with the sink top.

The present invention is also directed to a sink top having a basin, an underside and a pair of front corners. The first location of the first mounting means is on the underside of the sink top at the basin thereof. The first mounting means includes a substantially convex-shaped bottom portion on the sink top basin. The second location of the second mounting means is adjacent to the front corners on the underside of the sink top. The second mounting means includes a pair of slots each defined in the underside of the sink top adjacent to a respective one of the front corners of the sink top. Each of the slots includes an elongated longitudinal portion having an uniform transverse width and an enlarged central portion having a diameter greater than the width of the elongated longitudinal portion. The sink top also has a pair of rear corners. The sink top defines a pair of holes each adjacent to a respective one of the pair of rear corners for coupling with fasteners to attach the sink top to a wall structure.

The first sink base for the sink assembly is a central pedestal. The first mounting means further includes a top portion of the central pedestal. The top portion is substantially concave-shaped and thereby matches and is mateably engageable with the substantially convex-shaped bottom portion of the basin of the sink top.

The second sink base for the sink assembly is a pair of support legs. The second mounting means further includes a pair of fasteners each connecting a respective one of the support legs with the underside of the sink top via a respective one of the slots. Each support leg is hollow and each fastener has an externally threaded stem and an internally threaded head. The externally threaded stem of the fastener extends from a respective one of the hollow support legs and through a respective one of the slots. The internally threaded head of the fastener is threadably secureable over the stem above the respective one of the slots for securing the sink top and the support legs to one another.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 2:
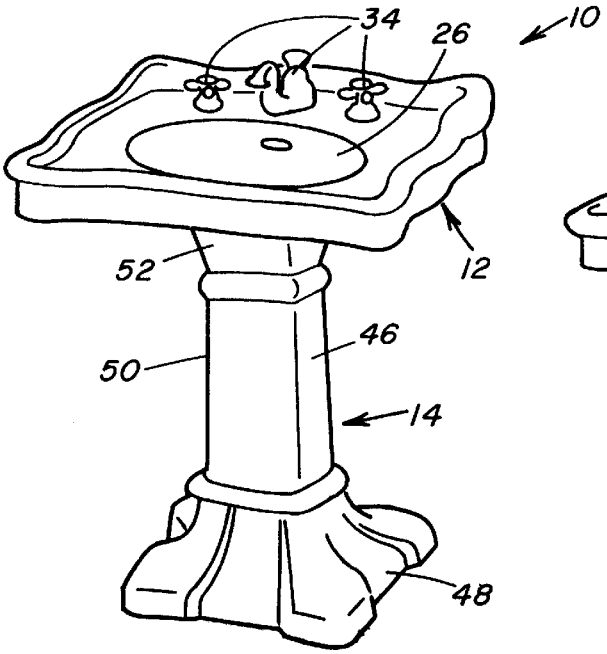
FIG. 2 is a perspective view of the sink assembly of the present invention having a central pedestal base of an alternative design to that of FIG. 1.
Figure 1:
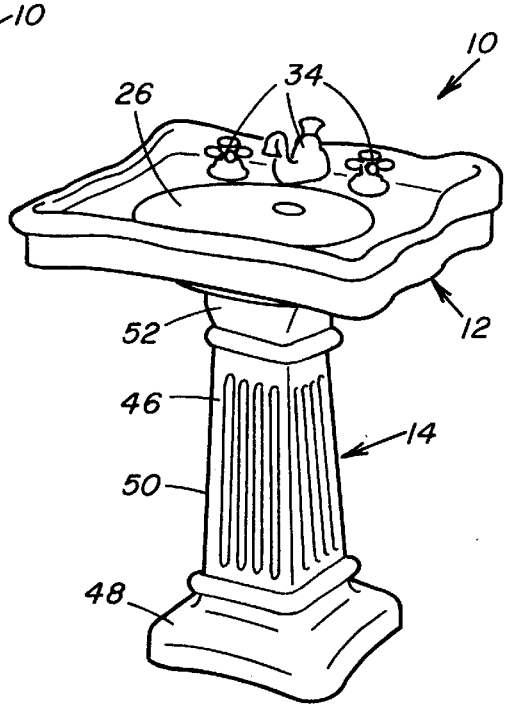
FIG. 1 is a perspective view of a sink assembly of the present invention having a sink top and a central pedestal as a base for the sink assembly.
Figure 3:
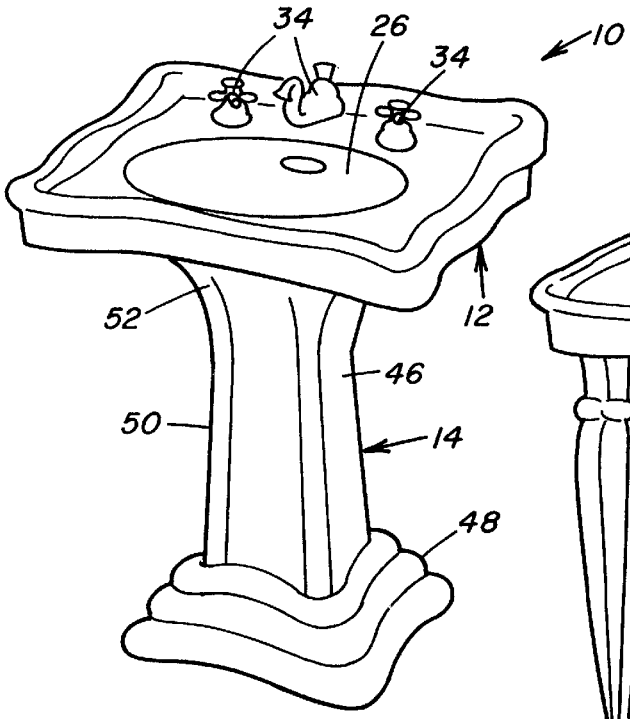
FIG. 3 is a perspective view of the sink assembly of the present invention having a central pedestal base of another alternative design to those of FIGS. 1 and 2.
Figure 4:
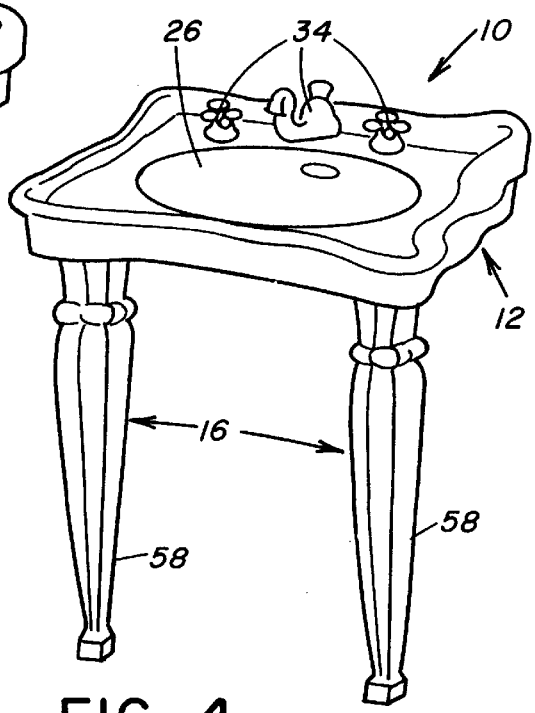
FIG. 4 is a perspective view of the sink assembly of the present invention having a pair of front corner support legs as the base for the sink assembly.

Referring to the drawings and particularly to FIGS. 1 to 4, there is illustrated a sink assembly, generally designated 10, of the present invention. Basically, the sink assembly 10 includes a sink top 12 of the present invention, a sink base being one or the other of at least two, or first and second, sink bases 14, 16 of different first and second styles, first mounting means 18 defined on the first sink base 14 and at a first location 20 on the sink top 12 for receiving and supporting the sink top 12 on the first sink base 14, and second mounting means 22 defined on the second sink base 16 and at a second location 24 on the sink top 12 for receiving and supporting the sink top 12 on the second sink base 16. The second mounting means 22 is different from the first mounting means 18 and the second location 24 of the second mounting means 22 on the sink top 12 is different from the first location 20 of the first mounting means 18 on the sink top 12. The first and second mounting means 18, 22 provide interchangeability of one for the other of the first and second bases 14, 16 of the different styles with the one sink top 12.

Figure 5:
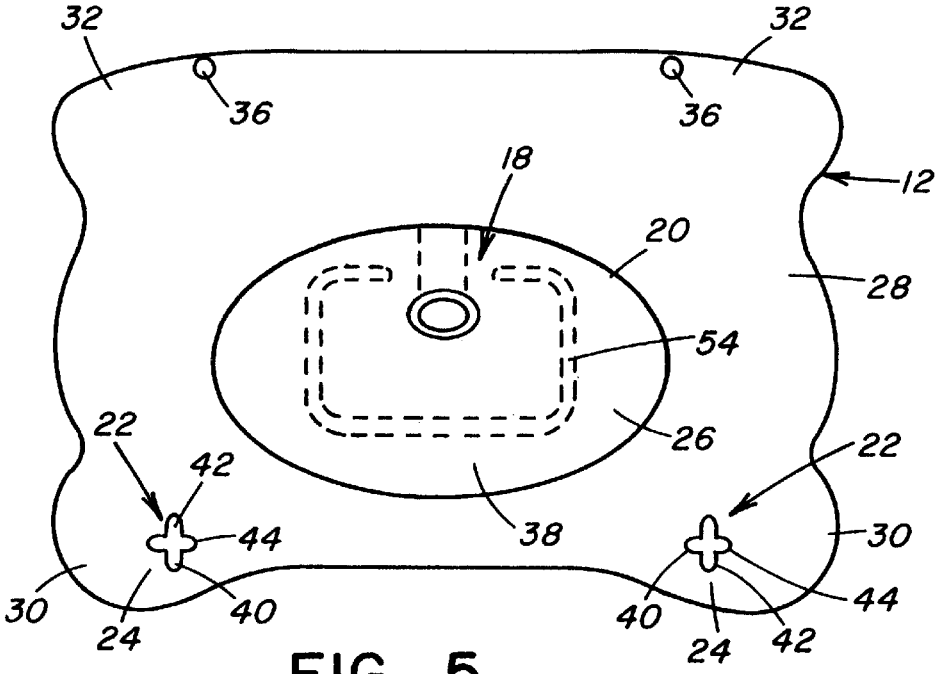
FIG. 5 is an enlarged bottom plan view of the sink top of the present invention.

Referring now to FIGS. 1 to 5, the sink top 12 of the present invention can be of any suitable ornamental design and has a basin 26, an underside 28, a pair of front corners 30, a pair of rear corners 32 and a plurality of conventional fixtures 34. The sink top 12 defines a pair of holes 36 each adjacent to a respective one of the rear corners 32 for coupling with fasteners (not shown) to attach the sink top 12 to a wall structure (not shown). The first location 20 of the first mounting means 18 is on the underside of the sink top 12 at the basin 26 thereof. The first mounting means 18 includes a substantially convex-shaped bottom portion 38 of the basin 26 of the sink top 12. The second location 24 of the second mounting means 22 is adjacent to the front corners 30 on the underside 28 of the sink top 12. The second mounting means 22 includes a pair of slots 40 each defined in the underside 28 of the sink top 12 adjacent to a respective one of the front corners 30 thereof. Each of the slots 40 includes an elongated longitudinal portion 42 having a uniform transverse width and an enlarged central portion 44 having a diameter greater than the width of the elongated longitudinal portion 42. The conventional fixtures 34 are mounted to and arranged around a rear perimeter of the basin 26.

Figure 6:
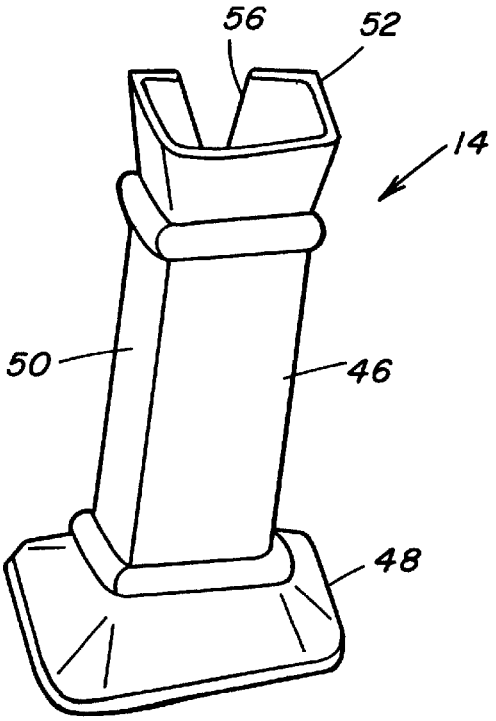
FIG. 6 is an enlarged perspective view of a central pedestal base similar to the one shown in FIG. 2.

Referring now to FIGS. 1 to 6, the first sink base 14 for the sink assembly 10 is preferably a central pedestal 46. The central pedestal 46 may have any suitable ornamental design, such as those shown in FIGS. 1 to 3 and 6. The central pedestal 46 includes a bottom portion 48, an upstanding portion 50 and a top portion 52. The bottom portion 48 has a given width. The upstanding portion 50 is attached to the bottom portion 48 and has a width less than the width of the bottom portion 48. The upstanding portion 50 has a tubular construction. The greater width of the bottom portion 48 over the width of the upstanding portion 50 provides a more stable sink assembly 10 when the sink top 12 is supported on the central pedestal 46. The top portion 52 of the pedestal 46 has a width greater than or the same as the width of the upstanding portion 50 of the pedestal 46 but less than the width of the bottom portion 48 of the pedestal 46 and is attached to the upstanding portion 50 thereof.

The first mounting means 18 further includes the top portion 52 of the central pedestal 46. The top portion 52 is substantially concave-shaped and thereby matches and is mateably engageable with the substantially convex-shaped bottom portion 38 of the basin 26 of the sink top 12. The area on the underside 28 of the sink top 12 where the basin 26 engages and seats on the top portion 52 of the central pedestal 46 is indicated by the C-shaped dashed outline 54 shown in FIG. 5. No fasteners are needed to mount the sink top 12 onto the central pedestal 46. The upstanding portion 50 of the central pedestal 46 defines a cutout 56 through which plumbing pipes can extend between a wall structure and the sink assembly 10.

Figure 7:
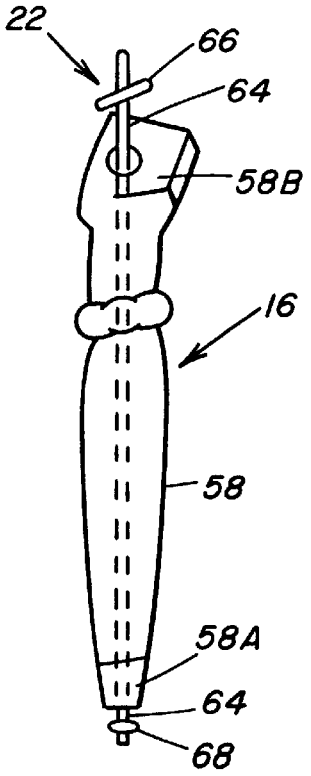
FIG. 7 is an enlarged perspective view of one of the front corner support legs of the base similar to one of the support legs shown in FIG. 4.

Referring now to FIGS. 1 to 7, the second sink base 16 for the sink assembly 10 is preferably a pair of elongated support legs 58. The support legs 58 may have any suitable ornamental design, such as that shown in FIGS. 4 and 7. Each support leg 58 has a substantially straight configuration and a top portion 60 engageable with the underside 28 of the sink top 12 at a respective one of the slots 40 of the second mounting means 22.

The second mounting means 22 further includes a pair of fasteners each connecting a respective one of the support legs 58 with the underside 28 of the sink top 12 via a respective one of the slots 40. Each support leg 58 is hollow. Each fastener has an externally threaded bolt stem 64 extending longitudinally through the hollow support leg 58 and an internally threaded head 66 threaded onto the top end of the bolt stem 64. The bolt stem 64 extends from a lower end 58A of the leg 58 to a top end 58B thereof. An enlarged head 68 is formed on the lower end of the bolt stem 64 for use in turning the bolt stem 64 relative to the leg 58. The externally threaded stem 64 extends from a respective one of the hollow support legs 58 and through a respective one of the slots 40. The internally threaded nut 66 is threadably secured over the stem 64 above the respective one of the slots 40 for securing the sink top 12 and the support legs 58 to one another.

From the foregoing description, it can be readily seen that the different styles of sink bases 14, 16 can be used with the sink top 12 as shown or any other suitable sink top 12 having the same first and second mounting means 18, 22 for connecting the sink top 12 to the selected one or the other of the at least two sink bases 14, 16 of the different styles. The features described above allow a reduction in the number of sink assembly combinations required to be maintained in inventory at any given time. This translates into a cost savings which far outweighs any cost added by the provision of these interchangeability features in the sink top 12 and bases 14, 16.

It is thought that the present invention and many of its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A sink assembly, comprising:

(a) a sink top having an underside;

(b) a sink base being one or the other of at least two different styles, wherein said one of said at least two different styles of sink base is a central pedestal and wherein said other of said at least two different styles of sink base is a pair of support legs; and (c) an arrangement of mounting elements defined on said different styles of sink bases and at different locations on said underside of said sink top for supporting said sink top on said sink base, said mounting elements of said sink bases and said respective mounting elements on said underside of said sink top being complementally configured to each other, and wherein said mounting elements for receiving said pair of support legs include a pair of slots, whereby interchangeability is provided of one for the other of said different styles of sink bases with said one sink top.

2. The sink assembly of claim 1 wherein said arrangement of mounting elements includes first mounting means defined on a first of said sink bases and at a first of said different locations on said underside of said sink top for receiving and supporting said sink top on said first sink base.

3. The sink assembly of claim 2 wherein said arrangement of mounting elements includes second mounting means defined on a second of said sink bases and at a second of said different locations on said underside of said sink top for receiving and supporting said sink top on said second sink base.

4. A sink assembly, comprising:

(a) a sink top having a basin with a pair of front corners and an underside;

(b) a sink base being one or the other of at least first and second sink bases of first and second styles being different from one another;

(c) first mounting means defined on said first sink base and by a centrally and substantially convex-shaped portion of said underside of said sink top for receiving and supporting said sink top on said first sink base; and (d) second mounting means defined on said second sink base and adjacent said front corners on said underside of said sink top for receiving and supporting said sink top on said second sink base, said second mounting means includes a pair of slots each defined in said underside of said sink top adjacent to a respective one of said front corners thereof, such that said first and second mounting means provide interchangeability of one for the other of said first and second sink bases with said sink top.

5. The sink assembly of claim 4 wherein said first sink base is a central pedestal, said first mounting means further including a substantially concave-shaped top portion of said central pedestal mateably engageable with said substantially convex-shaped bottom portion of said basin of said sink top.

6. The sink assembly of claim 4 wherein each of said slots includes an elongated longitudinal portion having an uniform transverse width and an enlarged central portion having a diameter greater than the width of the elongated longitudinal portion.

7. The sink assembly of claim 4 wherein said second sink base is a pair of support legs, said second mounting means further including a pair of fasteners each connecting a respective one of said support legs with said underside of said sink top via a respective one of said slots.

8. A sink top for use with one or the other of first and second sink bases in providing a sink assembly, said sink top comprising:

(a) a basin having an underside and a pair of front corners;

(b) first mounting means located centrally on said underside of said sink top for receiving and supporting said sink top on said first sink base; and (c) second mounting means located adjacent said front corners on said underside of said sink top for receiving and supporting said sink top on said second sink base, said first mounting means includes a substantially convex-shaped bottom portion on said basin of said sink top and said second mounting means includes a pair of slots each defined in said underside of said sink top adjacent to a respective one of said front corners thereof, such that said first and second mounting means permit interchangeability of one for the other of said first and second sink bases with said sink top in providing a sink assembly.

9. The sink top of claim 8 wherein each of said slots includes an elongated longitudinal portion having an uniform transverse width and an enlarged central portion having a diameter greater than the width of the elongated longitudinal portion.

10. The sink top of claim 8 further comprising:

a pair of rear corners; and means defining a pair of holes each adjacent to a respective one of said rear corners for coupling with fasteners to attach said sink top to a wall structure.

* * * * *